US006572407B1

(12) United States Patent
Ko

(10) Patent No.: US 6,572,407 B1
(45) Date of Patent: Jun. 3, 2003

(54) LOW PROFILE CABLE END CONNECTOR

(75) Inventor: David Tso-Chin Ko, Thousand Oaks, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/118,223

(22) Filed: Apr. 5, 2002

(51) Int. Cl.[7] ..... H01R 17/18
(52) U.S. Cl. ..... 439/582; 439/585; 439/98
(58) Field of Search ..... 439/578–585, 439/854, 855, 856, 63, 98

(56) References Cited

U.S. PATENT DOCUMENTS 4,799,900 A * 1/1989 Capp et al. ..... 439/585
5,263,877 A * 11/1993 Mitani ..... 439/585
5,772,470 A * 6/1998 Togashi ..... 439/582
5,879,190 A * 3/1999 Maruyama et al. ..... 439/582
6,099,350 A * 8/2000 Wright ..... 439/582
6,305,980 B2 * 10/2001 Ko ..... 439/582

* cited by examiner

*Primary Examiner*—Hien Vu
(74) *Attorney, Agent, or Firm*—Wei Te Chung

(57) ABSTRACT

A cable end connector includes a dielectric housing (10), a terminal (30) received in the housing, a shell (50) enclosing the housing, and a retainer (60) attached to the shell for holding a coaxial cable (70) therein. An inner conductor (71) of the coaxial cable is directly soldered to a lower surface of a bottom portion (31) of the terminal. Two locking tabs (63) of the retainer achieves two functions: keeping integrity of the cable end connector and grounding a braiding layer (73) of the coaxial cable.

7 Claims, 8 Drawing Sheets

LOW PROFILE CABLE END CONNECTOR

BACKGROUND OF THE INVENTION

1. Field of the Invention

The present invention relates to a connector, and more particularly to a low profile cable end connector for high frequency application.

2. Description of the Related Art

An RF (Radio Frequency) cable end connector is used for connecting a cable with an electronic device for transmitting RF signal. Such a conventional RF cable end connector is, for example, disclosed in U.S. Pat. Nos. 6,340,312 B1 and 6,305,980 B2. Both patents are invented by the same inventor of the present invention. Referring to FIGS. 8 and 9, which are similar to FIGS. 6 and 7 of the U.S. Pat. No. 6,340,312 patent, the cable end connector includes a dielectric housing 10', a terminal 30' received in the housing 10', a shell 50' enclosing the housing 10', and a retainer 60' attached to the shell 50' for holding a coaxial cable 70 therein. The terminal 30' includes a pair of mating portions 33' and a planar tail portion 31' extending rearwardly to contact with an inner conductor 71 of the coaxial cable 70. The shell 50' has a pair of arms 513' for accommodating the tail portion 31 ' of the terminal 30' therebetween. A pair of sealing tabs 5133' extend from free ends of the arms 513' for clamping a braiding layer 73 of the coaxial cable 70.

However, the cable end connector with such a design regarding the connection of the terminal 30' with the inner conductor 71 of the cable 70 cannot meet a higher operating frequency requirement, such as 6 GHz. To meet the high frequency requirement, the solder joint between the terminal 30' and the inner conductor 71 should be located as close as possible to the mating portion 33' of the terminal 30', and the terminal 30' and the inner conductor 71 should be minimized in size. Furthermore, particularly referring to FIG. 9, the retainer 60' of the cable end connector has a pair of locking tabs 63', a pair of braiding crimps 65' and a strain relief 69' respectively engaging with different portions of the cable 70 and the shell 50', which results in an increased lengthwise dimension and increased production cost of the cable end connector. In addition, the height of cable end connector is also required to be reduced to comply with the miniaturization trend.

Hence, a low profile cable end connector for high operating frequency application is required to overcome the disadvantages of the related art.

BRIEF SUMMARY OF THE INVENTION

A main object of the present invention is to provide a cable end connector for high operating frequency application.

Another object is to provide a cable end connector having a low profile and a reduced lengthwise dimension.

A cable end connector according to the present invention comprises a dielectric housing, a terminal received in the housing, a unitarily formed shell, and a retainer attached to the shell for holding a coaxial cable therein.

The housing includes a base portion and a tubular portion supported on the base portion. The terminal has a bottom portion and a pair of contacting wings extending upwardly from the bottom portion, wherein an inner conductor of a coaxial cable is soldered onto a lower surface of the bottom portion of the housing. The shell includes a planar portion attached to a bottom face of the base portion, and a trunk portion connected to the planar portion and enclosing the tubular portion of the housing. The trunk portion includes a pair of arms extending rearwardly to engage with a braiding layer of the coaxial cable. The retainer includes a pair of locking tabs respectively depending downwardly from opposite sides of the retainer for retaining the arms to the planar portion of the shell, and a contacting portion depressed from a top wall of the retainer to engage with the braiding layer of the coaxial cable. The locking tabs of the retainer achieves two functions: keeping the integrity of the cable end connector and grounding the braiding layer of the coaxial cable.

Other objects, advantages and novel features of the invention will become more apparent from the following detailed description when taken in conjunction with the accompanying drawings.

DETAILED DESCRIPTION OF THE INVENTION

Figure 1:
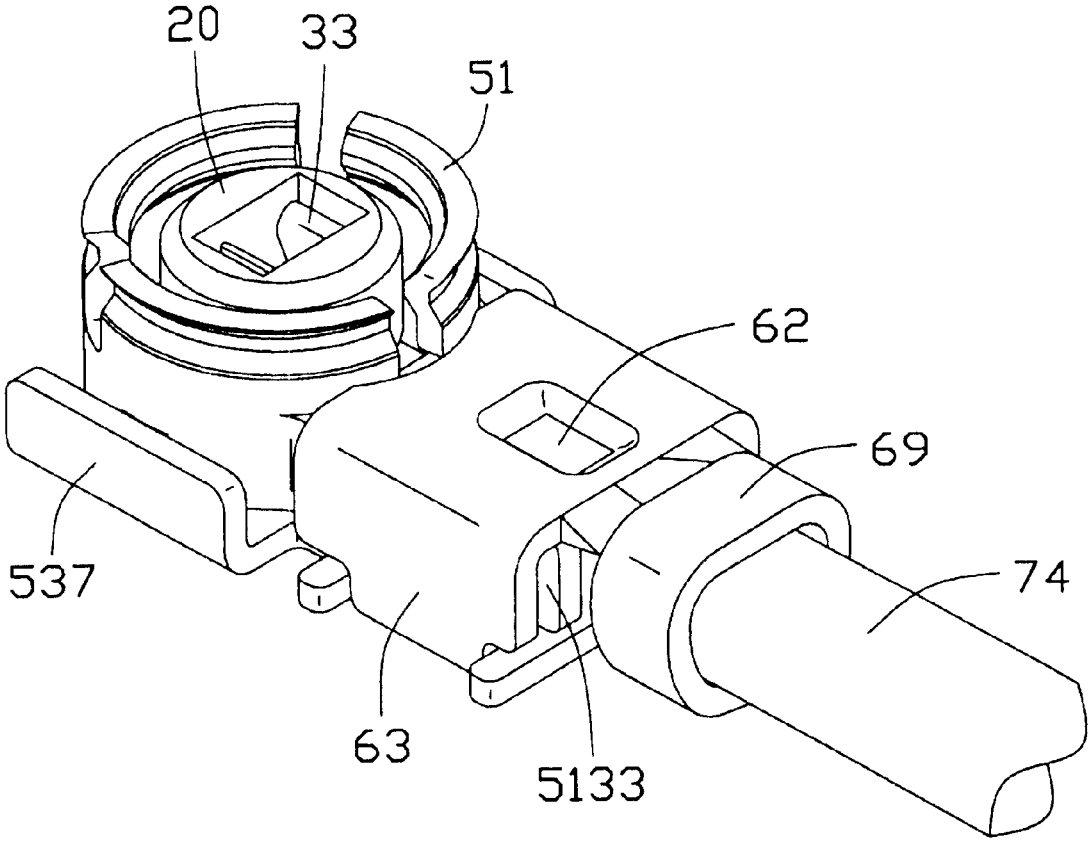
FIG. 1 is a perspective view of a cable end connector according to the present invention assembled with an end portion of a cable.

Referring to the drawings and particularly to FIGS. 1, 2, 4 and 5, a cable end connector in accordance with the present invention comprises a dielectric housing 10, a terminal 30, a metal shell 50 enclosing the housing 10 and the terminal 30, and a retainer 60 for securing an end portion of a coaxial cable 70 to the cable end connector.

Figure 2:
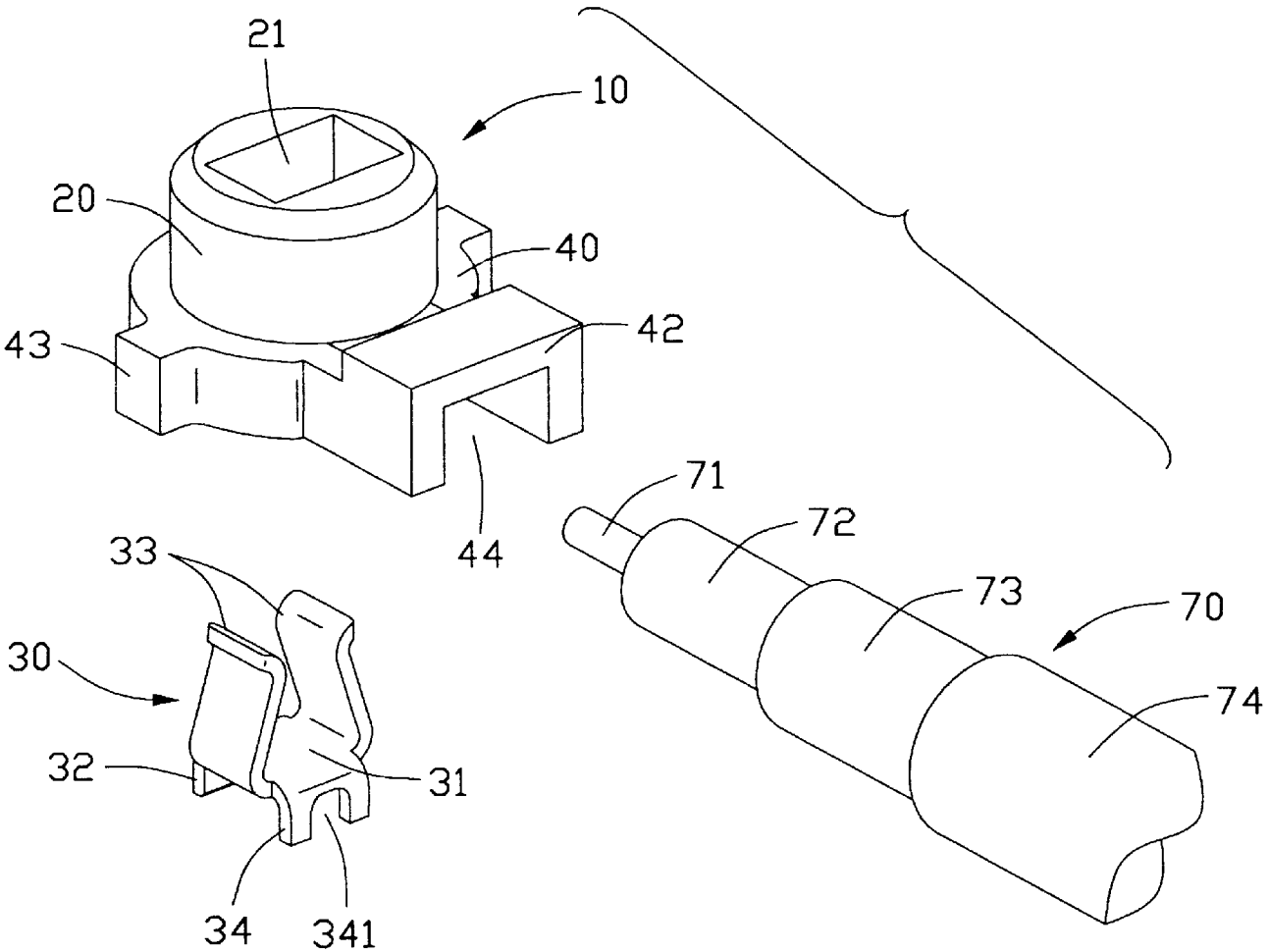
FIG. 2 is a partial, exploded view of the cable end connector of FIG. 1, including a housing, a terminal and the end portion of the cable.

Particularly referring to FIG. 2, the dielectric housing 10 comprises a base portion 40 and a tubular portion 20 supported on the base portion 40. A substantially rectangular passageway 21 is axially defined through the tubular portion 20.

The terminal 30 includes a bottom portion 31 and a pair of mating wings 33 extending respectively and upwardly from two opposite lateral sides of the bottom portion 31. The pair of mating wings 33 substantially extend toward each other for mating with a mating terminal of a complementary connector (not shown). A first and a second soldering tabs 32, 34 are bent respectively and downwardly from two opposite longitudinal sides of the bottom portion 31. A recess 341 is defined in each of the second soldering tabs 34.

Figure 3:
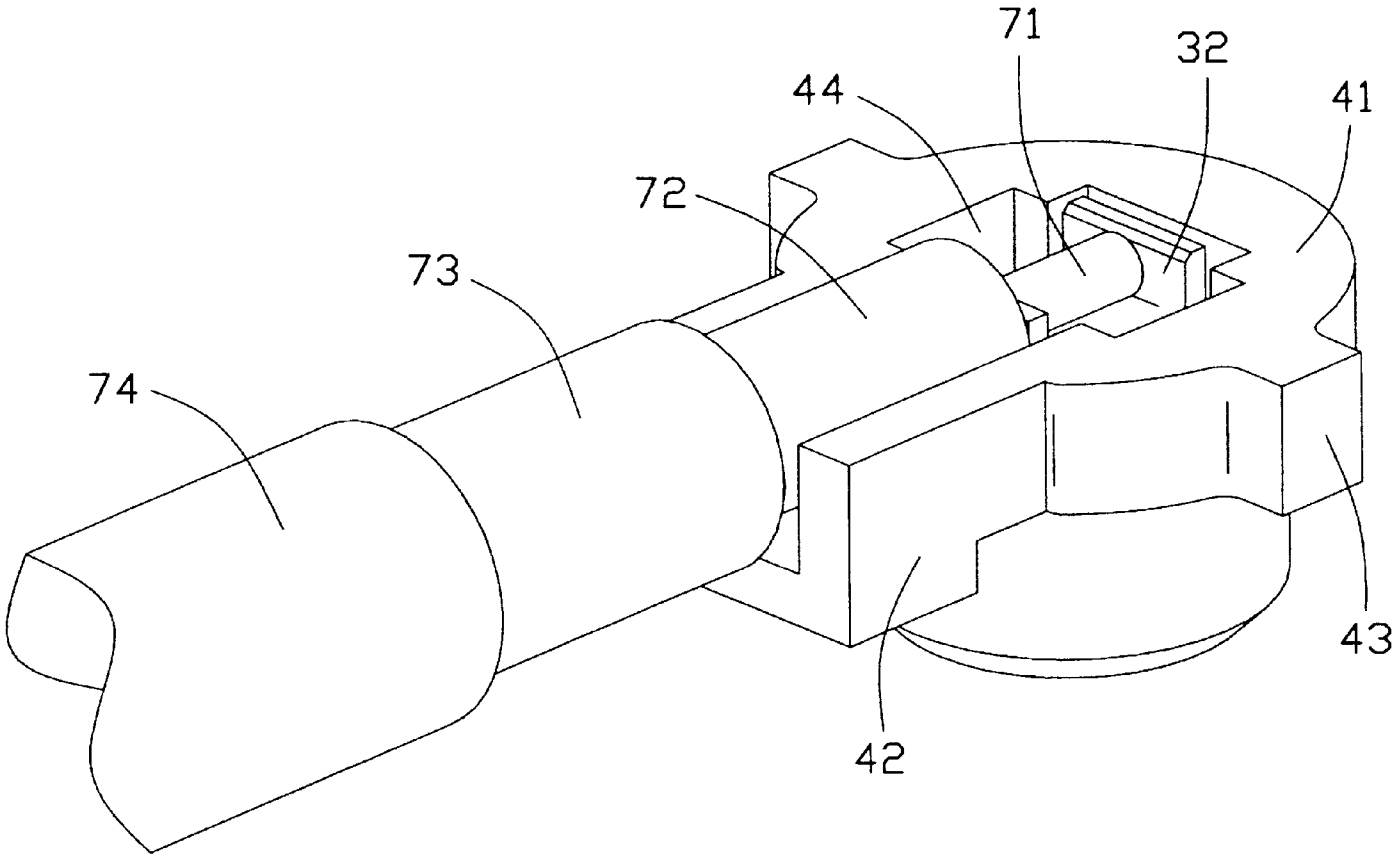
FIG. 3 is an assembled, upside-down view of FIG. 2.

Particularly referring to FIG. 3, the base portion 40 comprises a front circular portion 41 and a rear rectangular portion 42 extending rearwardly from the circular portion 41. A pair of engaging blocks 43 protrude laterally from the circular portion 41 to engage with the shell 50. A rearwardly exposed groove 44 is defined in a bottom of the base portion 40 and communicates with the passageway 21.

Figure 4:
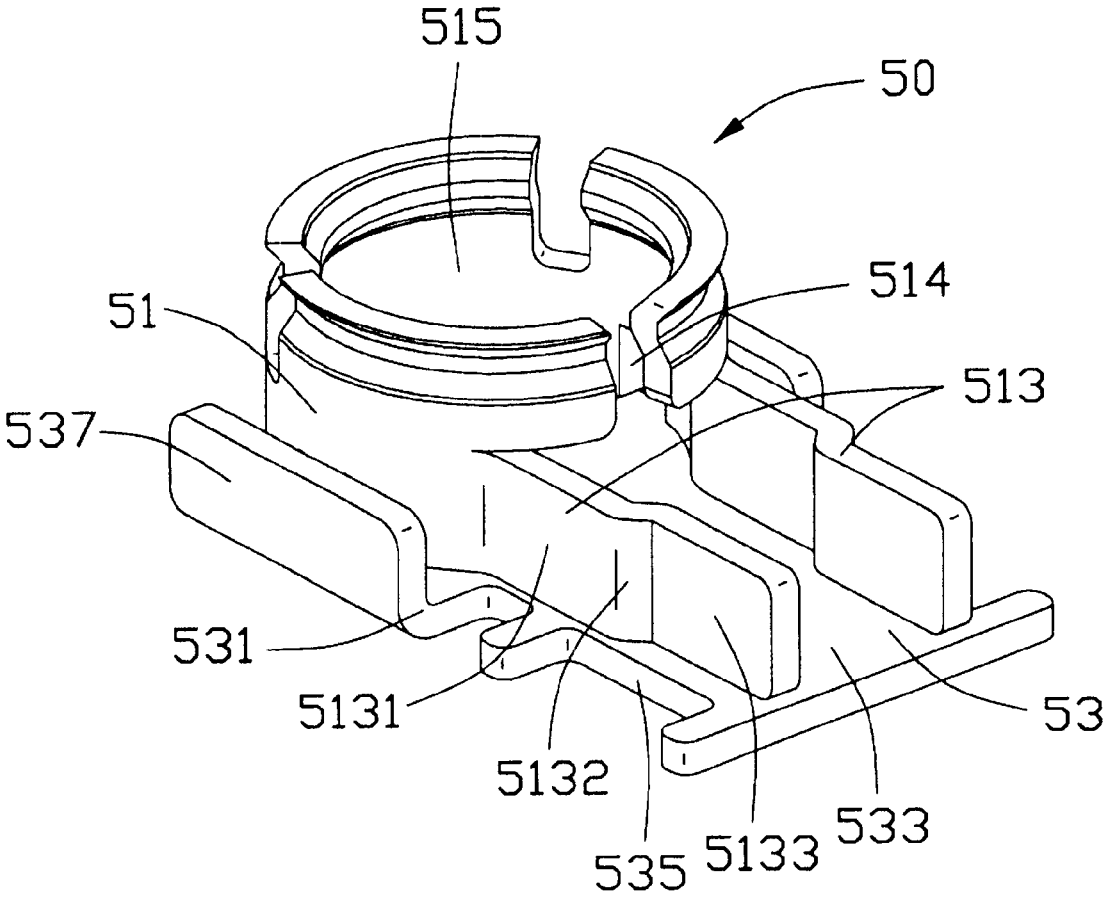
FIG. 4 is a perspective view of a shell of the cable end connector of FIG. 1

Referring to FIG. 4, the shell 50 is unitarily formed and comprises a substantially cylindrical trunk portion 51 and a substantially planar portion 53 connected to the trunk portion 51. It should be noted that, before bending; the planar portion 53 is oriented vertically below the trunk portion 51.

The trunk portion 51 has a pair of arms 513 rearwardly extending from a lower portion thereof. Each arm 513 has a straight portion 5131, a transition portion 5132 inwardly and rearwardly extending from the straight portion 5131, and a sealing tab 5133 rearwardly extending from the transition portion 5132. The trunk portion 51 defines a hollow portion 515 therethrough for receiving the tubular portion 20 of the housing 10. Preferably, a pair of holding recesses 514 (only one shown in FIG. 4) are formed in a lower portion of the trunk portion 51 for cooperating with the pair of engaging blocks 43 of the housing 10.

The planar portion 53 has a front portion 531 for supporting the trunk portion 51 of the shell 50 and the tubular portion 20 and the circular portion 41 of the housing 10, and a rear portion 533 rearwardly extending from the front portion 531 beyond the sealing tabs 5133 for supporting the arms 513 and the rectangular portion 42 of the housing 10. The front portion 531 forms a pair of side walls 537 on opposite sides thereof for interferentially engaging with the outer periphery of the trunk portion 51. A pair of recesses 535 are respectively defined in opposite sides of the rear portion 533.

Figure 5:
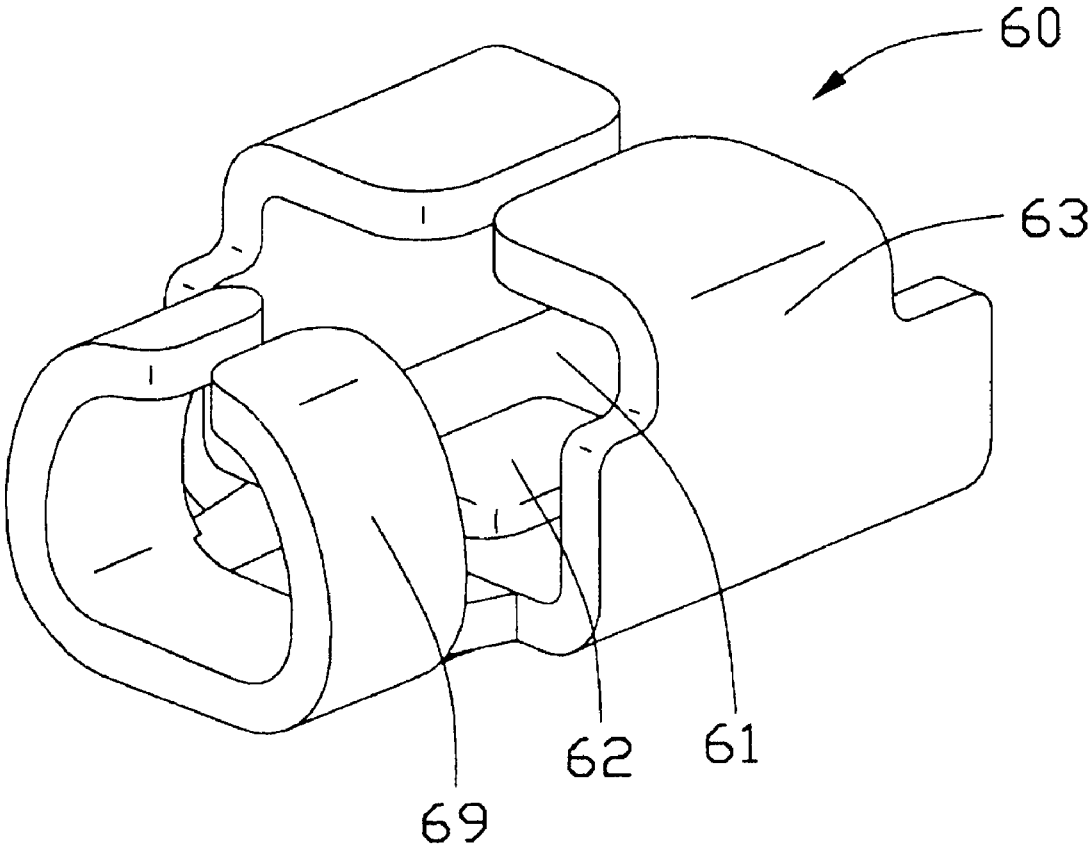
FIG. 5 is a perspective, upside-down view of a retainer of the cable end connector of FIG. 1.
Figure 6:
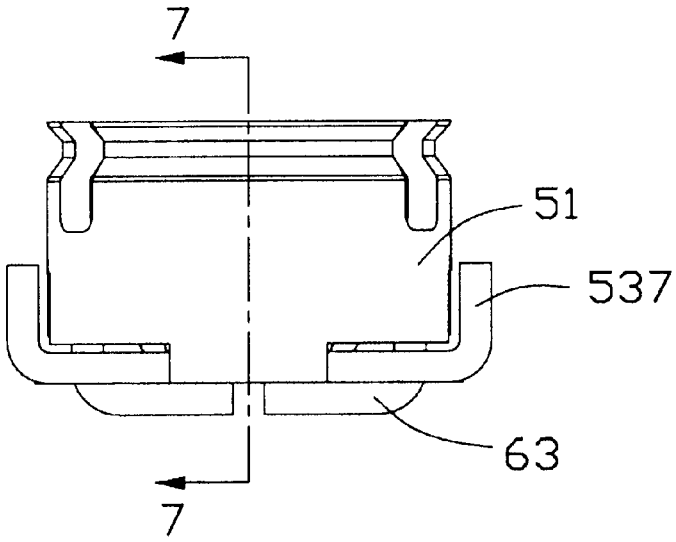
FIG. 6 is a front view of the cable end connector of FIG. 1.
Figure 7:
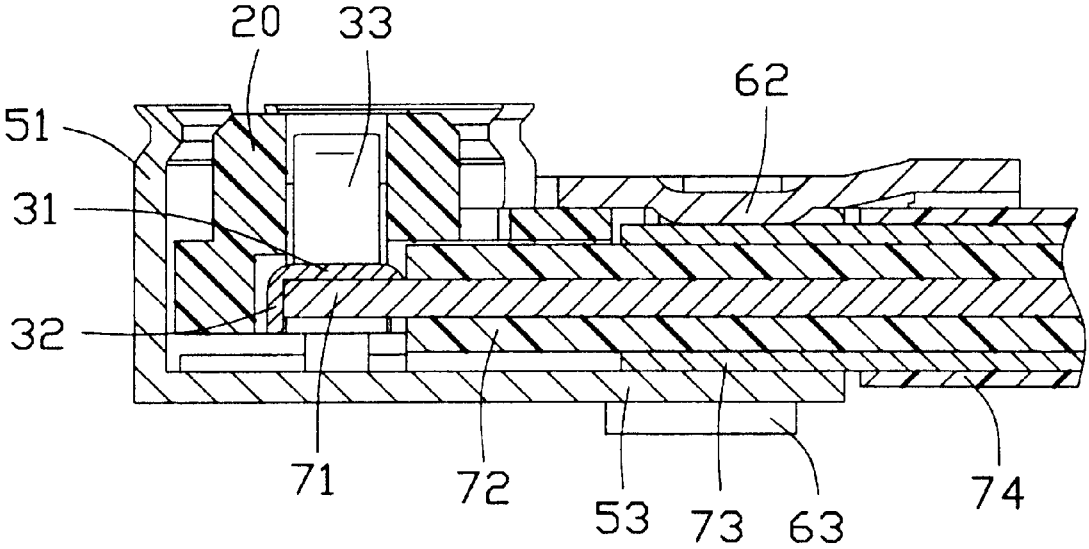
FIG. 7 is a cross-sectional view taken along a line 7—7 of FIG. 6.
Figure 8:
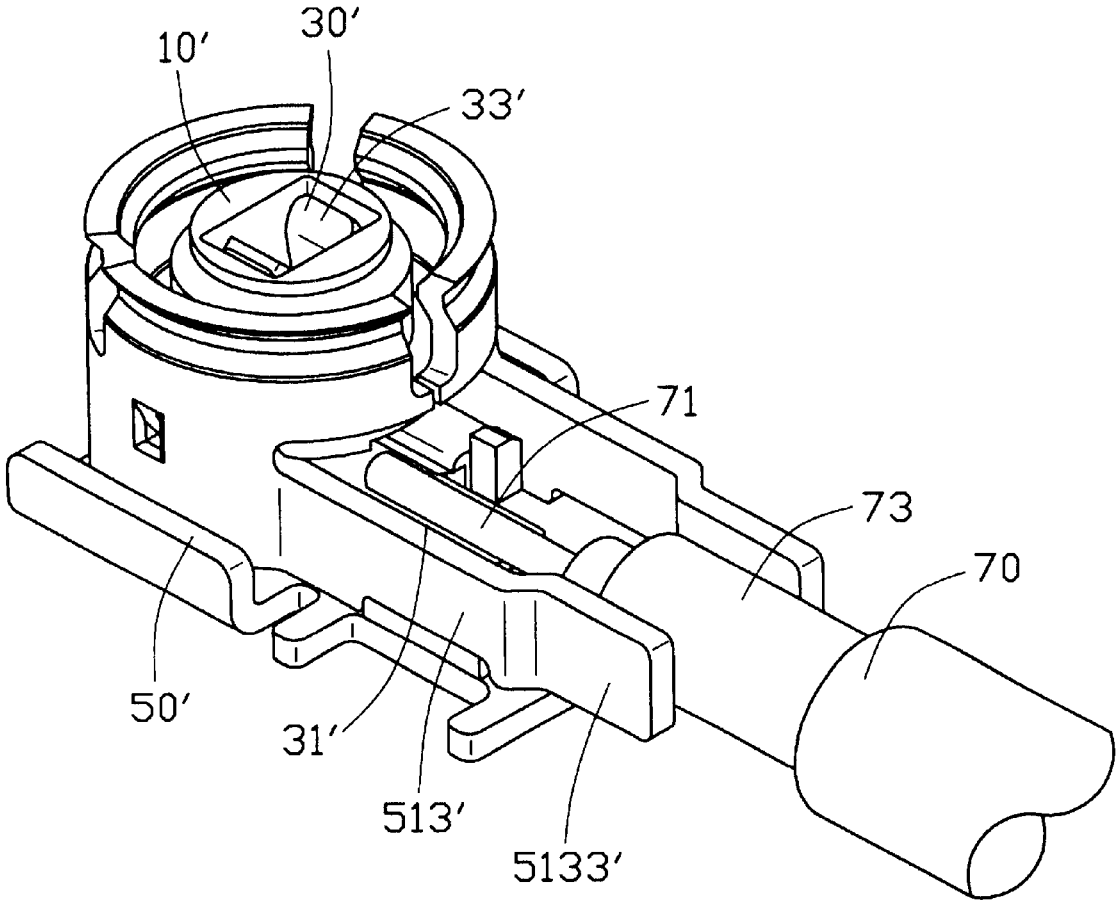
FIG. 8 (RELATED ART)
FIG. 8 is a view similar to FIG. 6 of U.S. Pat. No. 6,340,312 B1.

With reference to FIGS. 1 and 5, the retainer 60 is conductive and comprises a planar top wall 61 and a strain relief 69 rearwardly extending from a rear edge of the top wall 61 for securely clamping the coaxial cable 70. A contacting portion 62 is depressed from the top wall 61 and protrudes inwardly. A pair of locking tabs 63 respectively depend downwardly from two opposite lateral sides of the top wall 61 for engaging with the recesses 535 of the shell 50.

Particularly referring to FIG. 2, the coaxial cable 70 includes an inner conductor 71, a braiding layer 73, an inner insulator 72 separating the inner conductor 71 and the braiding layer 73, and an outer insulator 74 surrounding the braiding layer 73.

Referring to FIGS. 1, 2, 3, 6 and 7, the cable end connector of the present invention is assembled as follows.

(1) The contacting wings 33 of the terminal 30 is inserted into the passageway 21 through the groove 44 of the housing 10, abutting against corresponding inner walls (not labeled) of the passageway 21. The soldering tabs 32, 34 of the terminal 30 are retained in the groove 44.

(2) The inner insulator 72 of the coaxial cable 70 is received in the groove 44, and the inner conductor 71 extends forwardly through the recess 341 of the terminal 30 and is soldered to the soldering tabs 32, 34 and a lower surface of the bottom portion 31 of the terminal 30.

(3) The trunk portion 51 of the shell 50 encircles the tubular portion 20 of the housing 10 with the holding recesses 514 receiving the engaging blocks 43 therein. The arms 513 accommodate the rectangular portion 42 of the housing 10 therebetween.

(4) The planar portion 53 of the shell 50 which is originally oriented vertically downward is now bent toward the trunk portion 51 until the planar portion 53 completely abuts against the bottom of the housing 10.

(5) The locking tabs 63 of the retainer 60 engage with the corresponding recesses 535 and abut against the bottom of the planar portion 53, thereby fixedly retaining the arms 513 to an upper face of the planar portion 53. The braiding layer 73 of the coaxial cable 70 is therefore surrounded by both the arms 513 and the top wall 61 of the retainer 60. The shell 50 electrically connects with the braiding layer 73 by the arms 513 engaging with the braiding layer 73 and the retainer 60 electrically connects with the braiding layer 73 by the contacting portion 62 engaging with the braiding layer 73, which makes the braiding layer 73 reliably grounded. The outer insulator 74 of the coaxial cable 70 is firmly retained in the strain relief 69 of the retainer 60.

Figure 9:
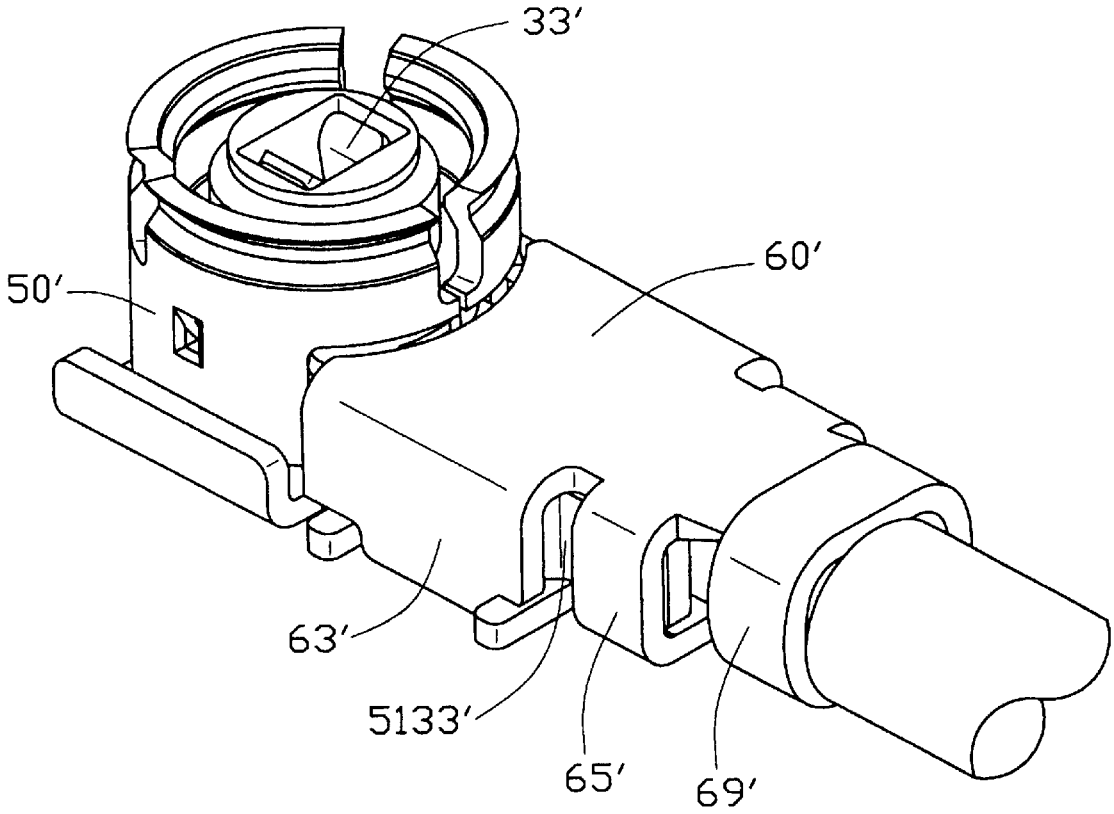
FIG. 9 (RELATED ART)
FIG. 9 is a view similar to FIG. 7 of U.S. Pat. No. 6,340,312 B1.

By such a design, the inner conductor 71 of the coaxial cable 70 is directly soldered onto a lower surface of the bottom portion 31 of the terminal 30 within the first planar portion 41 of the housing 10 to reduce the lengthwise dimension of the connector. The locking tabs 63 of the retainer 60 achieves two functions including keeping the integrity of the cable end connector and grounding the braiding layer 73 of the coaxial cable 70, which eliminates another crimping section 65' for grounding as shown in FIG. 9. By this arrangement, the solder joint between the terminal 30 and the inner conductor 71 of the cable 70 is close to the contacting wings 33 of the terminal 30, thereby meeting the high frequency requirements. In addition, the height of the cable end connector is also reduced due to the configuration of the housing 10 and the terminal 30.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable end connector assembly, comprising:

a coaxial cable including an inner conductor, a braiding layer, an inner insulator separating the inner conductor and the braiding layer, and an outer insulator surrounding the braiding layer; and a cable end connector assembled to an end portion of the coaxial cable, comprising:

a one piece insulative housing including a base portion and a tubular portion supported on said base portion;

a terminal received in said housing, the terminal having a bottom portion having a lower face soldered to the inner conductor of the coaxial cable and a mating wing extending upwardly from the bottom portion for electrically engaging with a complementary connector;

a metal shell including a planar portion attached to a bottom face of said base portion, and a trunk portion connected to said planar portion and enclosing said tubular portion of said housing, said trunk portion including a pair of arms extending rearwardly to engage with the braiding layer of the coaxial cable; and a discrete conductive retainer including a pair of locking tabs respectively depending downwardly from opposite sides of the retainer for retaining the arms to the planar portion, and a contacting portion depressed from a top wall of the retainer to engage with the braiding layer of the coaxial cable; wherein the base portion of the housing defines a groove in a bottom surface thereof to receive the inner conductor and the inner insulator of the coaxial cable, and wherein the tubular portion of the housing defines a passageway in communication with the groove, the wing of the terminal being received in the passageway; wherein the base portion of the housing comprises a pair of engaging blocks protruding laterally therefrom, and the trunk portion of the metal shell defines a pair of corresponding holding recesses for receiving the engaging blocks.

2. The cable end connector assembly as claimed in claim 1, wherein the terminal includes a pair of soldering tabs respectively depending downwardly from the bottom portion and received in the groove, at least one of the soldering tabs defining a recess for holding the inner conductor of the coaxial cable.

3. The cable end connector assembly as claimed in claim 1, wherein free ends of the arms of the metal shell substantially align with a rear side of the planar portion of the metal shell.

4. The cable end connector assembly as claimed in claim 1, wherein the retainer comprises a strain relief for retaining the outer insulator of the coaxial cable.

5. An electrical connector assembly, comprising:

a coaxial cable including a metal braiding layer, an inner conductor and an outer insulator;

a one piece insulative housing defining a base portion and a tubular portion, said tubular portion having a passageway, and a groove in a bottom surface of the base portion in communication with the passageway, the groove receiving the inner conductor of the cable therein;

a terminal substantially received in the passageway and having a bottom portion extending into the groove, the bottom portion having a lower surface soldered to the inner conductor of the coaxial cable, the terminal further having a mating portion extending upwardly from the bottom portion into the passageway for electrically engaging with a complementary connector;

a metal shell including a trunk portion and a planar portion, said shell substantially enclosing the housing, the braiding layer and the inner conductor of the coaxial cable therein; and a discrete conductive retainer having a top wall including a downwardly projecting contacting portion for pressing the braiding layer of the cable to the shell, and having a strain relief securely holding the outer insulator of the cable; wherein the base portion of the housing comprises a pair of engaging blocks protruding laterally therefrom, and the trunk portion of the metal shell defines a pair of corresponding holding recesses for receiving the engaging blocks.

6. The cable end connector assembly as claimed in claim 5, wherein the terminal includes at least one soldering tab depending downwardly from the bottom portion and received in the groove, the at least one soldering tab defining a recess for holding the inner conductor of the coaxial cable.

7. The cable end connector assembly as claimed in claim 5, wherein the retainer has a pair of locking tabs clamping arms of the metal shell to cause the arms to engage with the braiding layer of the cable, the locking tabs having free ends bent against the bottom of the shell.

* * * * *